US005320542A

United States Patent [19]

Cheng

[11] Patent Number: 5,320,542

[45] Date of Patent: Jun. 14, 1994

[54] SAFETY COVER FOR SOCKETS

[76] Inventor: Yu F. Cheng, No. 7, Fu Hsing St., Tu Cheng Hsiang, Taipei Hsien, Taiwan

[21] Appl. No.: 59,321

[22] Filed: May 7, 1993

[51] Int. Cl.[5] ..... H01R 13/44

[52] U.S. Cl. ..... 439/148; 174/67

[58] Field of Search ..... 439/135, 148; 174/67

[56] References Cited

U.S. PATENT DOCUMENTS

| | | | |
|---|---|---|---|
| 3,389,367 | 6/1968 | Schwartz | 439/148 |
| 5,017,148 | 5/1991 | Buckshaw | 439/148 |
| 5,236,369 | 8/1993 | Beach et al. | 439/148 |

*Primary Examiner*—Gary F. Paumen

*Attorney, Agent, or Firm*—Hopkins & Thomas

[57] ABSTRACT

A safety cover for sockets includes a cover body having a recess in a first side thereof and two spaced blades extending outward from the recess and being perpendicular to the cover body. The blades are adapted to engage with two slits of a socket. A clip extends from the cover body and pivotable at an end thereof adjacent to the cover body. The clip includes a pair of substantially L-shaped members each with a flexible distal end extending toward each other to define a passage having width slightly less than that of a wire of the plug, such that the safety cover clips on the wire of the plug when not in use. The distance between the L-shaped members is less than that between the blades. The cover body includes two cutouts to allow a pivotal movement of the L-shaped members into the recess. The recess has two spaced protrusions extending outward from a periphery thereof which is opposite to the cutouts to retain the L-shaped members when the clip is stored in the recess.

7 Claims, 5 Drawing Sheets

SAFETY COVER FOR SOCKETS

BACKGROUND OF THE INVENTION

The present invention relates to a safety cover for sockets.

In supplying electricity, sockets are useful in daily life and are generally exposed which sometimes causes accidents, such as electric shocks which are especially dangerous to children, as the sockets are accessible. Furthermore, dust and moisture in the air may cause the conductive plates mounted in the sockets to fail after a long term exposure to environment, especially when the sockets are installed outdoors.

Therefore, there has been a long and unfulfilled need for a safety cover for sockets to mitigate and/or obviate the aforementioned problems.

SUMMARY OF THE INVENTION

The present invention provides a safety cover for sockets which includes a cover body having a recess in a first side thereof and two spaced blades extending perpendicularly outward from the recess. The blades are adapted to engage with two slits of a socket.

A clip extends from the cover body and is pivotable at an end thereof adjacent to the cover body. The clip includes a pair of substantially L-shaped members each with a flexible distal end extending toward each other to define a passage having a width slightly less than that of cord of the plug, such that the safety cover may clip on the cord of the plug when the safety cover is not in use.

The cover body includes two cutouts to allow a pivotal movement of the L-shaped members into the recess. The distance between the L-shaped members is less than that between the blades. The recess has two spaced protrusions extending outward from a periphery thereof which is opposite to the cutouts to retain the L-shaped members when the clip is stored in the recess. The cover body, the blades, and the clip are preferably made of insulating material. The blades are preferably made of rigid material for repeatedly inserting into and removal from the socket.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
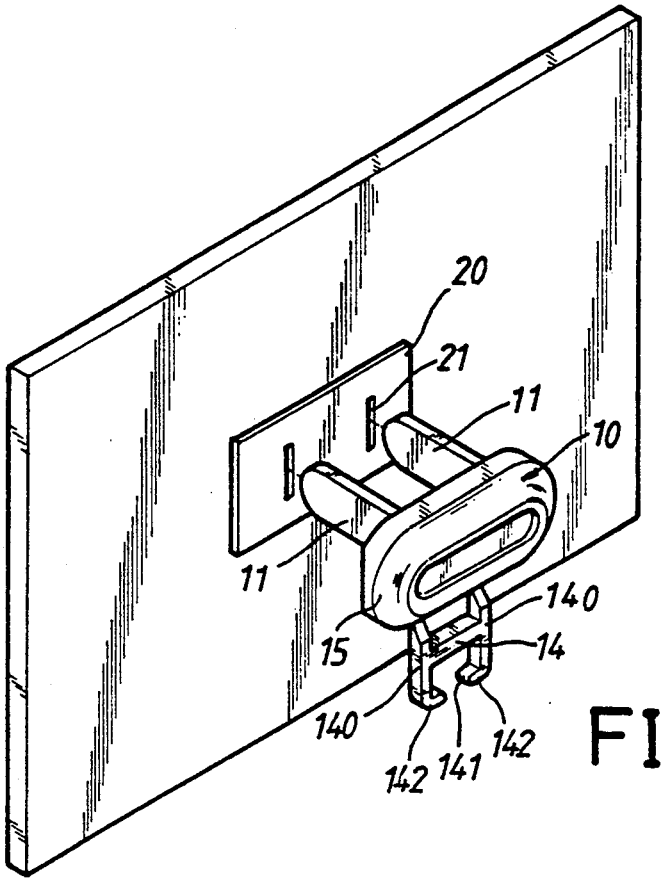
FIG. 1 perspective view of a safety cover for sockets in with the present invention and a socket.

Referring to FIGS. 1 through 4, a safety cover 10 for sockets in accordance with the present invention generally includes a cover body 15 having a recess 12 in a first side thereof and two spaced blades 11 extending perpendicularly outward from the recess 12. The blades 11 are adapted to engage with two slits 21 of a socket 20, as shown in FIG. 1.

The safety cover further includes a clip means 14 extending from the cover body 15 which is pivotable at an end thereof and which is adjacent to the cover body 15. The clip means 14 includes a pair of substantially L-shaped member 140 each with a flexible distal end 142 extending toward each other to define a passage 141 therebetween. The passage 141 has a width slightly less than that of the cord 31 of the plug 30. By the provision of the clip means 14, the safety cover 10 may clip on the cord 31 of the plug 30 when the safety cover 10 is not in use, as clearly shown in FIG. 6.

Figure 2:
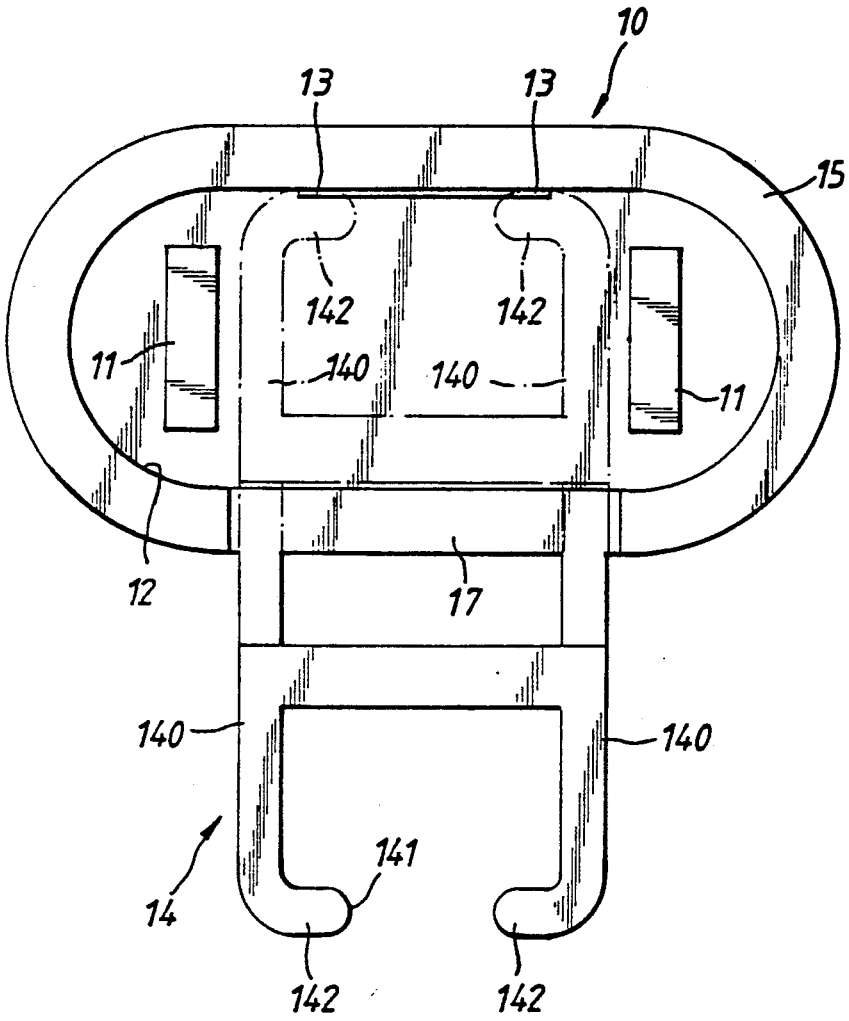
FIG. 2 is a rear elevational view of the safety cover for sockets with the present invention.
Figure 2A:
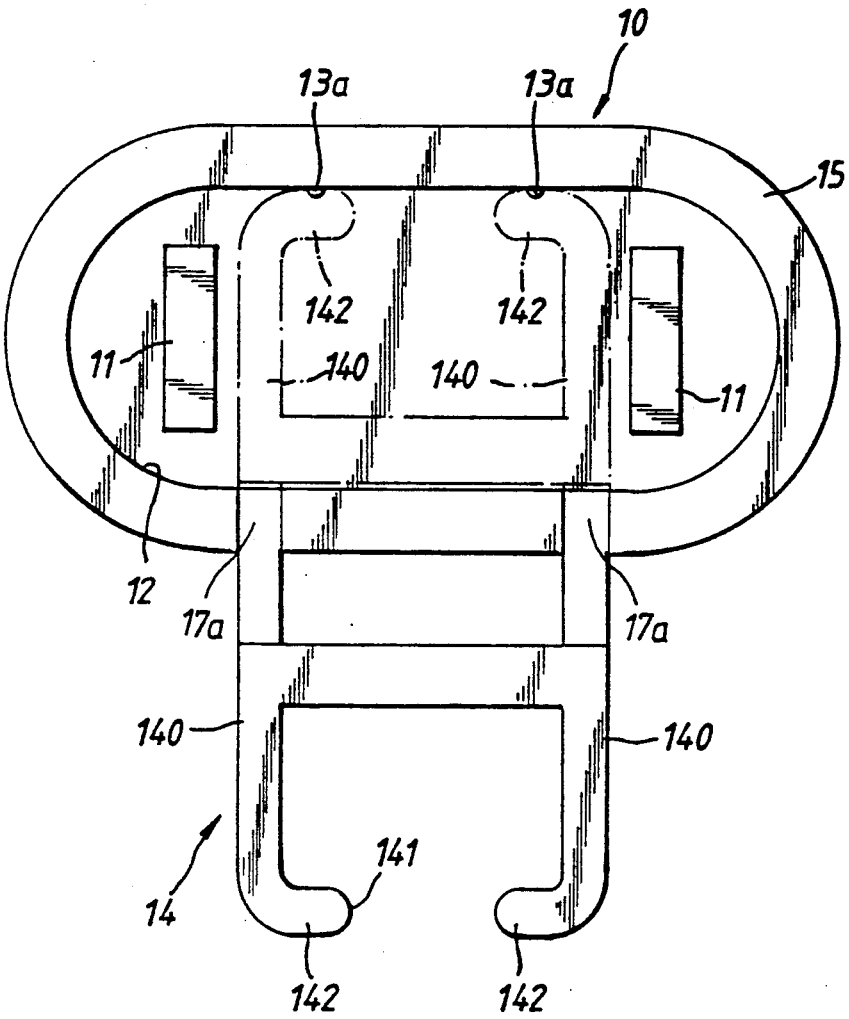
FIG. 2*a* is a rear elevational view of another embodiment of the cover, assembly for sockets in accordance with the present invention.

Referring to FIG. 2, the cover body 15 includes a cutout 17 having a width greater than that between the L-shaped members 140 to allow a pivotal movement of the L-shaped members 140 into the recess 12. The distance between the L-shaped members 140 is less than that between the blades 11. Preferably, the recess 12 has a ridge 13 extending inward from a periphery thereof which is opposite to the cutout 17 to retain the L-shaped members 140 when the clip means 14 is stored in the recess 12. It is appreciated that other types of retaining member can be used to retain the L-shaped member, such as two spaced protrusions 13*a* extending outward from the above-mentioned periphery, as shown in FIG. 2*a*. Alternatively, as shown in FIG. 2*a*, the long cutout 17 may be replaced by two spaced cutouts 17*a* which still allows the pivotal movement of the L-shaped members. Preferably, the cover body 15, the blades 11, and the clip means 14 are made of insulating material. Preferably, the blades 11 are made of rigid material for repeatedly inserting into and removal from the socket 20.

Figure 5:
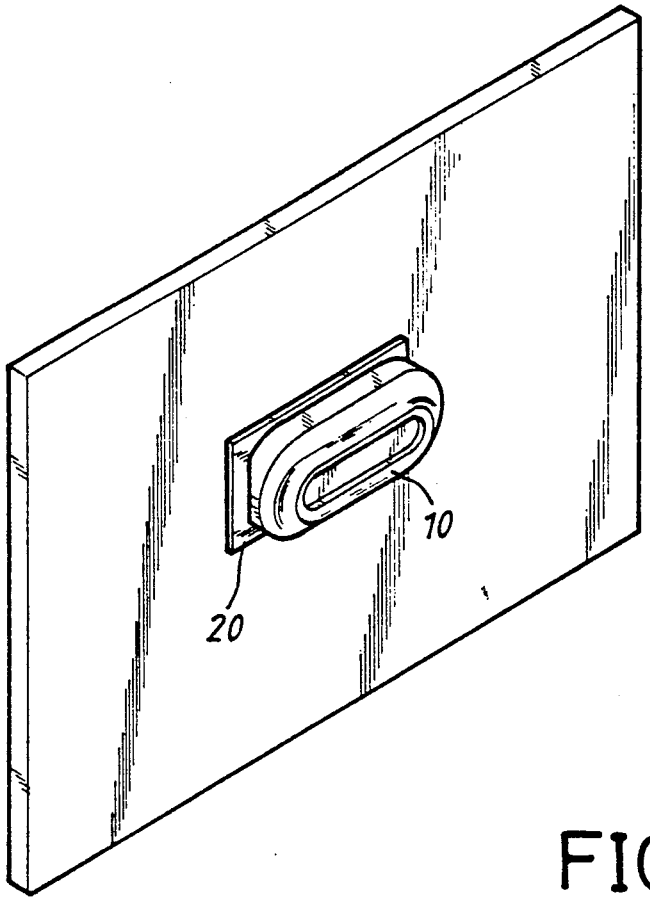
FIG. 5 is a perspective view in which the blades of the safety cover are inserted into a socket to shield the latter.
Figure 3:
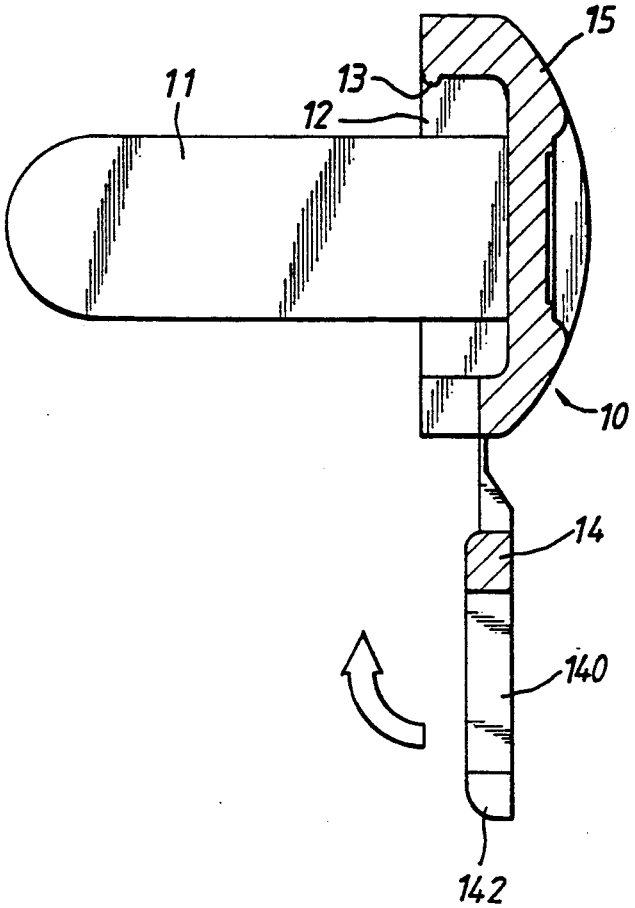
FIG. 3 is a cross-sectional side view of the safety cover for sockets.
Figure 4:
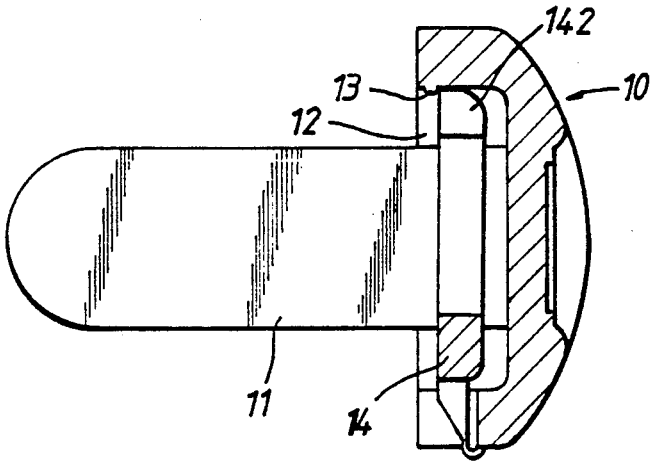
FIG. 4 is a cross-sectional side view similar to FIG. 3 in which the clip means of the safety cover is received in the recess of the safety cover body.
Figure 6:
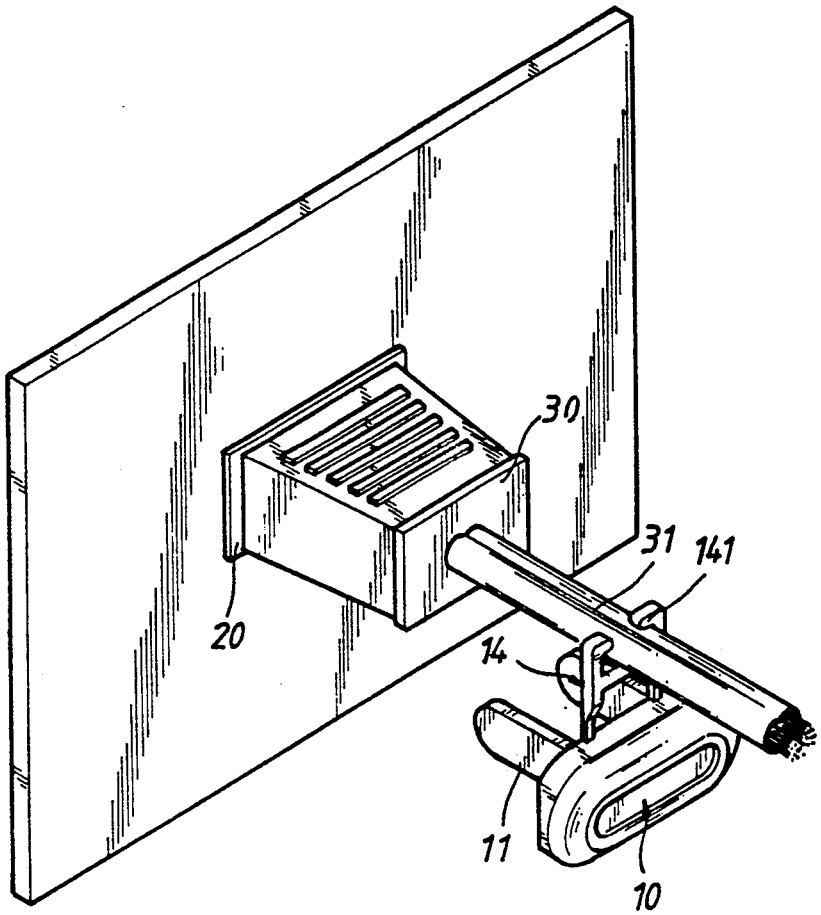
FIG. 6 is a perspective view in which the safety cover is attached to the cord of a plug when not in use.

FIGS. 3 and 4 shows the operation of the storage of the clip means 14. FIG. 5 shows the operation of the safety cover. It is apparent that the socket 20 is .now covered and that accident is prevented. Furthermore, dust and moisture in air are prevented from entering into the socket 20. Referring to FIG. 6, when the plug 30 is to be used, the safety cover 10 is removed from the socket 20 and is clipped on the cord 31 of the plug 30 by means of the clip means 14 thereof, preventing the safety cover 10 from being lost.

Although the invention has been explained in relation to its preferred embodiment, it is to be understood that many other possible modifications and variations can be made without departing from the spirit and scope of the invention as hereinafter claimed.

I claim:

1. An insulative safety cover body for sockets comprising:

a cover body having a recess in a first side thereof;

two spaced insulative blades extending perpendicularly outward from said recess, said blades being adapted to engage with two slits of a socket;

a clip means extending from said cover body such that said safety cover body clips on a cord of a plug when not in use; and said clip means including a pair of substantially L-shaped members each with a flexible distal end extending toward each other to define a passage having a width slightly less than that of the cord of the plug.

2. The safety cover as claimed in claim 1 wherein each said L-shaped member is pivotable at an end thereof adjacent to said cover body and said cover body includes at least one cutout to allow a pivotal movement of said L-shaped members into said recess.

3. The safety cover as claimed in claim 2 wherein a distance between said L-shaped members is less than that between said blades.

4. The safety cover as claimed in claim 3 wherein said recess has a member extending inward from a periphery of said recess which is opposite to said cutouts, said member retaining said L-shaped members when said L-shaped members are stored in said recess.

5. The safety cover as claimed in claim 4 wherein said member includes a pair of protrusions for retaining associated ones of said flexible distal ends of said L-shaped members.

6. The safety cover as claimed in claim 4 wherein said member includes a ridge extending outward from said periphery of said recess.

7. An insulative safety cover body for sockets comprising:

a cover body having a recess in a first side thereof;

two spaced blades extending perpendicularly outward from said recess, said blades being adapted to engage with two slits of a socket;

a clip means extending from said cover body such that said safety cover body clips on a cord of a plug when not in use;

said clip means including a pair of substantially L-shaped members each with a flexible distal end extending toward each other to define a passage having a width slightly less than that of the cord of the plug; and wherein each said L-shaped member is pivotable at an end thereof adjacent to said cover body and said cover body includes at least one cutout to allow a pivotal movement of said L-shaped members into said recess.

* * * * *